US006082569A

United States Patent [19]

Druitt

[11] Patent Number: 6,082,569

[45] **Date of Patent: *Jul. 4, 2000**

[54] LINERLESS CLOSURE FOR CARBONATED BEVERAGE CONTAINER

[75] Inventor: Rodney M. Druitt, North Luffenham, United Kingdom

[73] Assignee: Closures and Packaging Services Limited, Guernsey, United Kingdom

[ * ] Notice: This patent is subject to a terminal disclaimer.

[21] Appl. No.: 09/150,342

[22] Filed: Sep. 10, 1998

Related U.S. Application Data

[63] Continuation of application No. 08/899,285, Jul. 23, 1997, Pat. No. 5,836,464, which is a continuation of application No. 08/718,022, Sep. 23, 1996, abandoned, which is a continuation of application No. 08/490,020, Jun. 12, 1995, abandoned, which is a continuation of application No. 08/181,668, Apr. 21, 1994, Pat. No. 5,638,972, which is a continuation-in-part of application No. 07/623,911, Mar. 14, 1991, Pat. No. 5,423,444.

[30] Foreign Application Priority Data

Jun. 17, 1988 [AU] Australia ..... PT8846
Jun. 15, 1989 [WO] WIPO ..... PCT/AU89/00256

[51] Int. Cl.[7] ..... B65D 53/00

[52] U.S. Cl. ..... 215/344; 215/343; 215/DIG. 1

[58] Field of Search ..... 215/341, 343, 215/344, DIG. 1

[56] References Cited

U.S. PATENT DOCUMENTS

| | | |
|---|---|---|
| 0,069,040 | 12/1867 | Corsette . |
| 3,038,624 | 6/1962 | Weickmann . |
| 3,053,406 | 9/1962 | Wandell . |
| 3,055,526 | 9/1962 | Plunkett . |
| 3,067,900 | 12/1962 | Kessler . |
| 3,141,586 | 7/1964 | Wetterek . |
| 3,151,757 | 10/1964 | Martin . |
| 3,200,981 | 8/1965 | Harding . |
| 3,203,571 | 8/1965 | Plunkett . |
| 3,224,617 | 12/1965 | Hohl et al. . |
| 3,255,907 | 6/1966 | Eddy . |
| 3,286,866 | 11/1966 | McIntosh . |
| 3,393,818 | 7/1968 | McIntosh . |
| 3,405,830 | 10/1968 | Hayashida . |
| 3,494,496 | 2/1970 | Livingstone . |
| 3,568,871 | 3/1971 | Livingstone . |
| 3,583,591 | 6/1971 | Hayashida . |
| 3,632,005 | 1/1972 | Kessler . |
| 3,784,041 | 1/1974 | Birch . |
| 3,802,590 | 4/1974 | Culver . |
| 3,814,274 | 6/1974 | McIntosh . |
| 3,851,784 | 12/1974 | Gryncewicz . |
| 3,854,618 | 12/1974 | Beghini . |
| 3,865,263 | 2/1975 | Birch . |
| 3,948,405 | 4/1976 | Yonker . |
| 3,986,627 | 10/1976 | Zapp . |
| 3,990,598 | 11/1976 | Zapp et al. . |
| 4,016,996 | 4/1977 | Aichinger et al. . |
| 4,061,240 | 12/1977 | Brownbill . |
| 4,069,937 | 1/1978 | Smalley . |
| 4,089,463 | 5/1978 | Babiol . |
| 4,090,631 | 5/1978 | Grussen . |
| 4,125,201 | 11/1978 | Birch . |
| 4,177,906 | 12/1979 | Von Hagel . |
| 4,196,818 | 4/1980 | Brownbill . |
| 4,210,251 | 7/1980 | Grussen . |
| 4,220,250 | 9/1980 | Brownbill . |
| 4,253,581 | 3/1981 | Aichinger et al. . |
| 4,276,989 | 7/1981 | Hicks . |
| 4,301,937 | 11/1981 | Von Hagel . |
| 4,325,487 | 4/1982 | Libit . |
| 4,349,116 | 9/1982 | Luesner . |
| 4,398,645 | 8/1983 | Toeppen . |
| 4,416,383 | 11/1983 | Frahm et al. . |
| 4,442,947 | 4/1984 | Banich, Sr. . |
| 4,450,973 | 5/1984 | Toeppen . |
| 4,459,835 | 7/1984 | Hurskainen . |
| 4,461,392 | 7/1984 | Conti . |
| 4,462,502 | 7/1984 | Luesner . |
| 4,526,284 | 7/1985 | Herbert . |
| 4,540,102 | 9/1985 | Wiedmer . |
| 4,598,835 | 7/1986 | Brownbill . |
| 4,623,070 | 11/1986 | Nishikawa . |
| 4,708,255 | 11/1987 | Thompson . |
| 4,726,484 | 2/1988 | Lutz . |
| 4,739,893 | 4/1988 | Zumbuhl . |
| 4,768,669 | 9/1988 | Zane et al. . |
| 4,793,506 | 12/1988 | Thompson . |
| 4,811,857 | 3/1989 | Thompson . |
| 4,823,967 | 4/1989 | Thompson . |
| 4,856,668 | 8/1989 | Pfefferkorn . |
| 4,872,304 | 10/1989 | Thompson . |
| 4,905,852 | 3/1990 | Zumbuhl . |
| 4,907,709 | 3/1990 | Abe et al. . |
| 4,917,269 | 4/1990 | Fuchs et al. . |
| 5,320,236 | 6/1994 | Gregory ..... 215/344 |
| 5,423,444 | 6/1995 | Druitt . |
| 5,609,263 | 3/1997 | Perchepied ..... 215/344 X |
| 5,638,972 | 6/1997 | Druitt . |
| 5,782,369 | 7/1998 | Tansey ..... 215/344 |
| 5,791,506 | 8/1998 | Sheffler et al. ..... 215/341 X |

FOREIGN PATENT DOCUMENTS

| | | |
|---|---|---|
| 923966 | 2/1968 | Australia . |
| 44533/68 | 4/1970 | Australia . |
| 1418083 | 3/1983 | Australia . |

(List continued on next page.)

*Primary Examiner*—Stephen Cronin
*Assistant Examiner*—Robin A. Hylton
*Attorney, Agent, or Firm*—McDermott, Will & Emery

[57] ABSTRACT

A plastic closure for sealing a container, the closure having a top portion and a skirt portion depending from the top portion. The closure has an annular sealing rib which extends within the cavity defined by the top portion and the skirt portion. The rib includes a first portion having a substantially cylindrical inner surface extending away from the underside of the top portion and disposed radially inward of the skirt and a second, frusto-conical, portion contiguous with the end of the first portion distal to the underside of the top portion and extending radially inwardly and terminating in a circular free edge, such that during engagement of the cap with the neck of the container, the second, frusto-conical, portion will be engaged by the free end of the neck and folded back against the first portion of the rib to form a gas-tight seal between the neck of the container and the closure.

23 Claims, 7 Drawing Sheets

FOREIGN PATENT DOCUMENTS

| | | |
|---|---|---|
| 716415 | 8/1965 | Canada . |
| 955887 | 10/1974 | Canada . |
| 109631 | 11/1870 | European Pat. Off. . |
| 136088 | 4/1873 | European Pat. Off. . |
| 0146011 | 11/1984 | European Pat. Off. . |
| 293901 | 12/1988 | European Pat. Off. . |
| 1270357 | 10/1918 | France . |
| 1550358 | 11/1925 | France . |
| 1213812 | 10/1958 | France . |
| 1107541 | 10/1959 | Germany . |
| 1807328 | 11/1967 | Germany . |
| 8006293 | 4/1979 | Germany . |
| 3008838 | 10/1980 | Germany . |
| 169850 | 4/1982 | Netherlands . |
| RU 37413 | 12/1981 | Poland . |
| RU 37844 | 12/1981 | Poland . |
| 302888 | of 1971 | Russian Federation . |
| 2008201 | 9/1986 | Spain . |
| 407786 | 2/1966 | Switzerland . |
| 587755 | 3/1977 | Switzerland . |
| 0607702 | 10/1978 | Switzerland . |
| 788148 | 12/1957 | United Kingdom . |
| 930866 | 7/1963 | United Kingdom . |
| 935574 | 8/1963 | United Kingdom . |
| 1024762 | 4/1966 | United Kingdom . |
| 1229322 | 4/1971 | United Kingdom . |
| 1499895 | 2/1978 | United Kingdom . |
| 1602746 | 11/1983 | United Kingdom . |
| 2120219 | 11/1983 | United Kingdom . |
| 2131774 | 6/1984 | United Kingdom . |

LINERLESS CLOSURE FOR CARBONATED BEVERAGE CONTAINER

This application is a continuation of application Ser. No. 08/899,285 filed Jul. 23, 1997, (U.S. Pat. No. 5,836,464) which is a continuation of application Ser. No. 08/718,022 filed Sep. 23, 1996 abandoned; which is a continuation of application Ser. No. 08/490,020 filed Jun. 12, 1995 abandoned; which is a continuation of application Ser. No. 08/181,668 filed Apr. 21, 1994 (U.S. Pat. No. 5,638,972), which is a Continuation-in-Part of application Ser. No. 07/623,911 filed Mar. 14, 1991 (U.S. Pat. No. 5,423,444).

FIELD OF THE INVENTION

This application is a continuation of U. S. patent application Ser. No. 07/623,911, having a 35 U.S.C. 371 filing date of Mar. 14, 1991 and an international filing date of Jun. 15, 1989 and a continuation of U.S. patent application Ser. No. 08/181,668, filed Jan. 14, 1994.

This invention relates to caps for sealing the opening of screw top containers. In particular, the invention provides a screw top cap which seals bottles of carbonated liquid such as soft drinks, but is well adapted to seal other containers such as glass or PET containers with contents at above or below atmospheric pressure or having gaseous components, or requiring a hermetic seal.

BACKGROUND OF THE INVENTION

Screw top caps have been used for some time to seal various containers. Although many screw tops include a separate sealing gasket within the cap, there is substantial advantage to be had in producing a one-piece cap which will effectively seal the container.

Such a one piece cap is shown in the British patent 788148 (Aug. 3, 1956) which includes a continuous lip within the top portion of the cap positioned to engage against the annular end face of the opening and provide a seal between the lip and the front edge of the container with the lip curling over at its free edge. However, this cap provides a seal only against the free end edge of the container.

Australian application 15456/76 (Jun. 30, 1976) discloses an alternative one-piece cap in which an annular lip extends from the inside top of the cap and engages the inner bore of a container opening so as to curl the free end of the lip in against the bore or inside surface of the container opening. However, with this cap, effective sealing requires that the inside bore of the opening be of accurate and consistent dimension. Furthermore, if aerated or other gaseous liquid is to be contained, gas pressure will tend to distort the lip and cause a seal failure.

Australian patent application 14180/83 (May 5, 1983) describes a cap with two internal sealing structures. One of the structures is an annular shaped outer portion shaped to accept the outer peripheral edge of the free end of the container relying upon the pressure generated during the closing of the cap to seal against this outer edge. Further provided is an inner cylindrical lip to engage the inner bore of the container opening.

SUMMARY OF THE PRESENT INVENTION

According to the present invention there is provided a closure for a container, having an externally screw threaded neck, said closure being molded in one piece from a resilient plastic material and comprising a top portion and a depending skirt which has on its internal surface a complementary screw thread, characterized in that an annular sealing rib projects downwardly from the underside of the top portion, the rib includes a first substantially cylindrical portion having a substantially cylindrical inner surface and a substantially cylindrical outer surface, the first cylindrical portion being contiguous with the top and lying adjacent to or abutting with the skirt and a second, frusto-conical, portion contiguous with the end of the first portion distal to the top and extending radially inwardly to terminate in a circular free edge, the internal diameter of the first portion being equal to or only slightly larger than the external diameter of the neck of the container to which the closure is to be attached such that, during threaded engagement of the cap with the neck, the second, frusto-conical portion will be engaged by the free end of the neck and folded back against the substantially cylindrical surface of the first substantially cylindrical portion of the rib to form a gas-tight seal between at least an outer surface of the neck of the container and the closure.

Preferably the plastic material is high density polyethylene, low density polyethylene, or polypropylene. Where the container is to be used for gaseous liquids, the plastic material must have a very low porosity to the gas. Preferably the rib is shaped and sized so that, during the threaded engagement of the closure with the container, the free edge of the rib contacts an inner surface of the top, or the surface of structure contiguous with the top, before the closure is fully engaged and such that the rib in the region proximate the free edge is pinched between the free end of the neck of the container and the top of the closure, or the structure contiguous with the top of the closure, when the closure is fully engaged with the container.

Preferably the first substantially cylindrical and second frusto-conical portions of the rib join at an included angle of at least 90°. It is also preferred that the rib is tapered, having a maximum thickness proximate the top portion of the closure and tapering to a minimum thickness at its annular free edge.

It is also preferred that the first substantially cylindrical and second frusto-conical portions of the rib smoothly join with an internal radius of from 0.1 mm to 0.5 mm, most preferably 0.2 mm. It is further preferred, that the cross-sectional thickness of the rib proximate the interface between the first and second portions is from 0.4 mm to 0.8 mm, most preferably approximately 0.6 mm.

Where the closure is adapted to seal a container with an Alcoa step finish, the first substantially cylindrical portion of the sealing rib joins the top spaced radially inwardly from the skirt so as to define a space of annular cross-section between the rib and skirt. Where the container neck has a standard finish the rib is closely spaced from, or contiguous with, the skirt.

BRIEF DESCRIPTION OF THE DRAWINGS

An exemplary embodiment of the invention will now be described with reference to the drawings which show.

PREFERRED EMBODIMENTS

Figure 1:
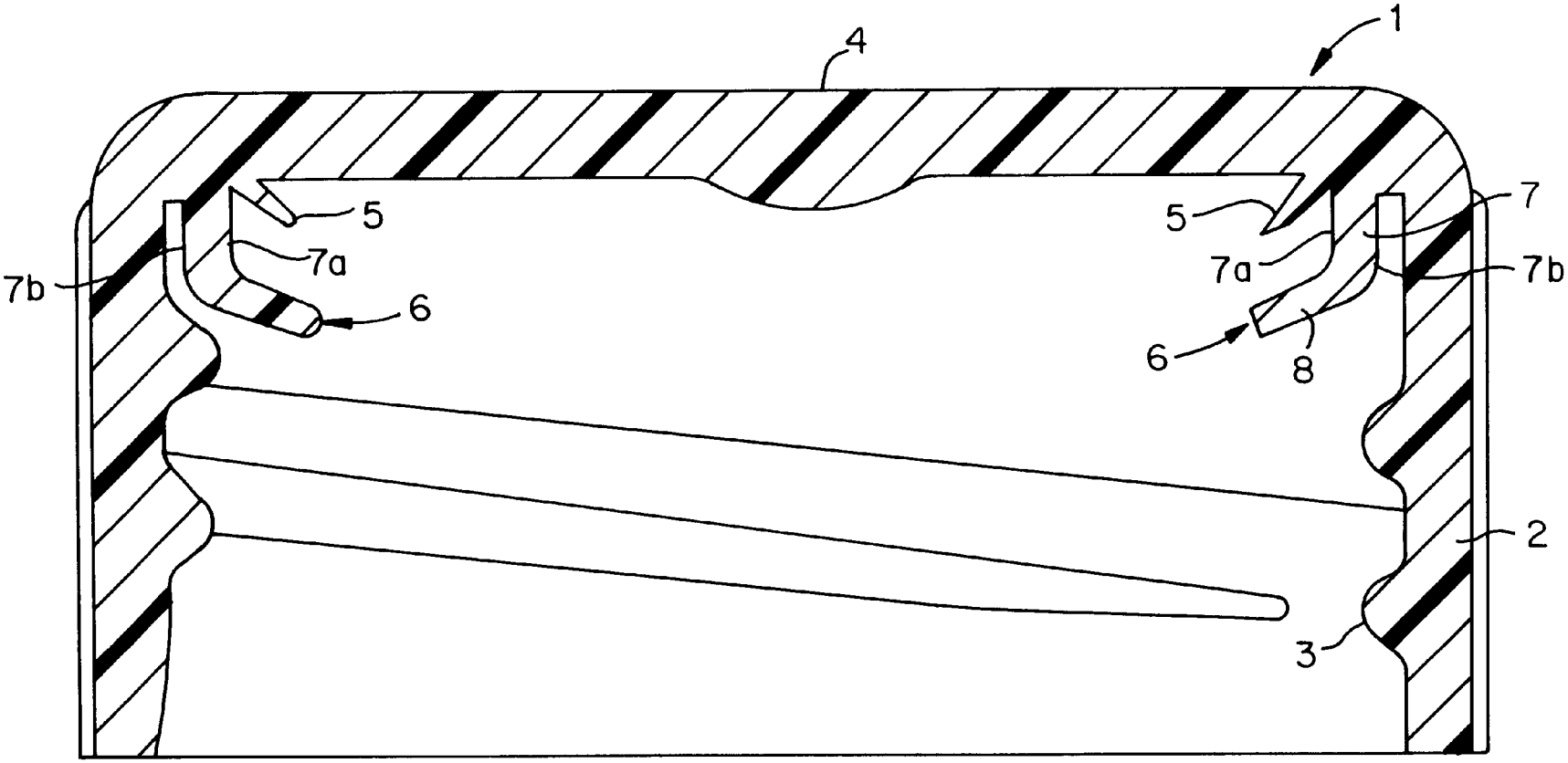
FIG. 1 is an embodiment of the closure of the present invention shown in sectional elevation.

FIG. 1 shows a cap 1 which is in many aspects a conventional screw top cap for a bottle to be used in containing a carbonated beverage. The cap 1 includes a continuous cylindrical sidewall or skirt 2 with a thread 3 formed on its interior surface. The top end of the cap 1 is closed by a top 4 which joins the skirt 2 in a continuous circular perimeter. The top portion 4 and skirt 2 are formed integrally from high density polyethylene by injection molding.

The cap differs from known caps in that it includes a concentric annular rib 6 which extends from the underside of the top portion 4 of the cap 1; the rib being positioned close to the skirt 2. The annular sealing rib 6 includes a first or root portion 7, which extends from the underside of the top portion 4 approximately parallel to the skirt 2, and a second portion 8 extending from the end of the first portion 7 distal to the top portion 4 and tapering inwardly and away from the skirt 2. The first portion 7 of the annular sealing rib 6 has a substantially cylindrical radial inner surface 7*a* and a substantially cylindrical radial outer surface 7*b*.

Figure 2:
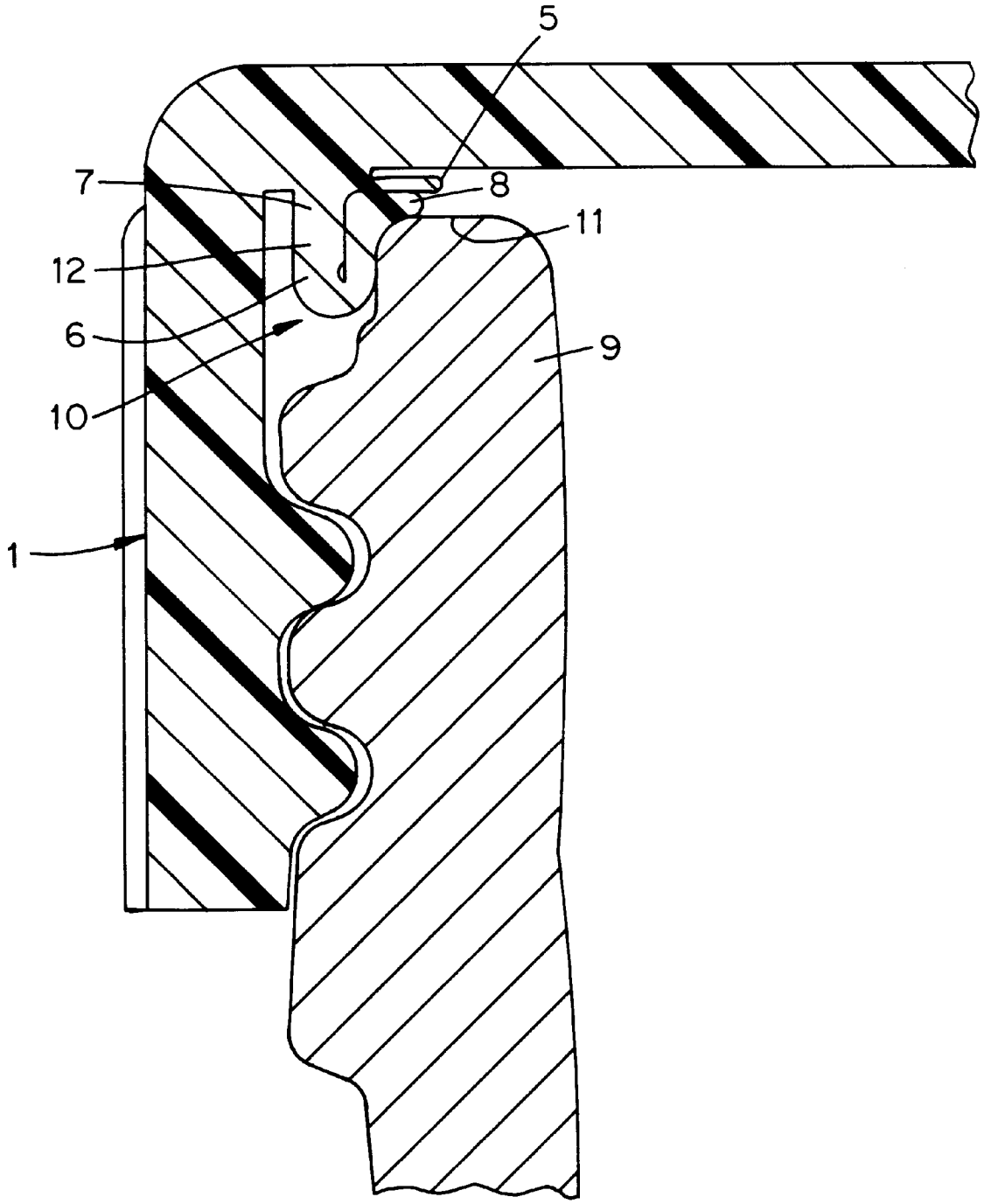
FIG. 2 is a partial view of the embodiment of FIG. 1 screwed onto a suitable container shown in sectional elevation.

The cap 1 can be seen in FIG. 2 screwed onto the screw top end 9 of a container not fully shown in the drawing. The end 9 of the container is finished with an Alcoa step 10 at the outer periphery of its open end extremity. The Alcoa step 10 allows a space between the end 9 of the container and the inner surface of the skirt 2 of the cap 1. The size of this annular space is sufficient to allow the second portion 8 of the annular rib 6 to contact the end of the container as the cap 1 is being screwed onto the container and for the second portion 8 to fold up on itself and against the substantially cylindrical inner surface 7*a* of the rib 6 and structure integral with the top portion 4. Thus there is formed a continuous gas tight seal between the cap 1 and the container extending from the Alcoa step 10 to the end surface of the container. There is no need of a separate seal inserted into the cap 1 prior to its application to the container as is common in the art.

As the cap 1 is attached in the above described manner, the second portion 8 of the sealing rib 6 is deformed by being bent toward the top 4. The deformation continues and contact is made between the second portion 8 of the sealing rib 6 and an inner rib 5 which effectively extends the structure of the top 4. The inner rib 5 in fact is not essential to the invention and can be dispensed with if the other components are suitably modified so that the second portion 8 contacts the top portion 4 during this deformation.

Once the second portion 8 has contacted the inner rib 5 (or top portion 4) further movement to attach the cap 1 will press and grip the contacting part of the second portion 8 between the container end 9 and the top portion 4. As the movement attaching the cap 1 continues, it tends to pinch the free edge of rib 6 between the container and the top portion 4 and to "pull" the first portion 7 of the annular rib 6 tightly in towards the container end 9 to produce a tight seal about the curved edge surface of the container end 9 extending from its extreme end annular surface 11 to the Alcoa step region 10.

In the preferred embodiment shown in the drawings, an annular gap 12 is formed between the annular rib 6 and the skirt 2, proximate the top portion 4. This is one means of accommodating the Alcoa step 10 and allowing the necessary movement of the annular rib 6 during application of the cap 1 to a container end 9.

The dimensions of the outer rib 6, in conjunction with the design shape of the rib 6 and its material of construction, will clearly influence the effectiveness of the cap 1. Not only the sealing effectiveness but also the moldability, removal torque, reusability and consistency are important. For the high density polyethylene cap shown in the drawings, the inner radius joining the first and second portions 7 and 8 of the annular rib 6 is 0.2 mm, the outer radius 0.5 mm and the cross-sectional thickness at the joinder approximately 0.6 mm (slightly tapered for mold removal).

Figure 3:
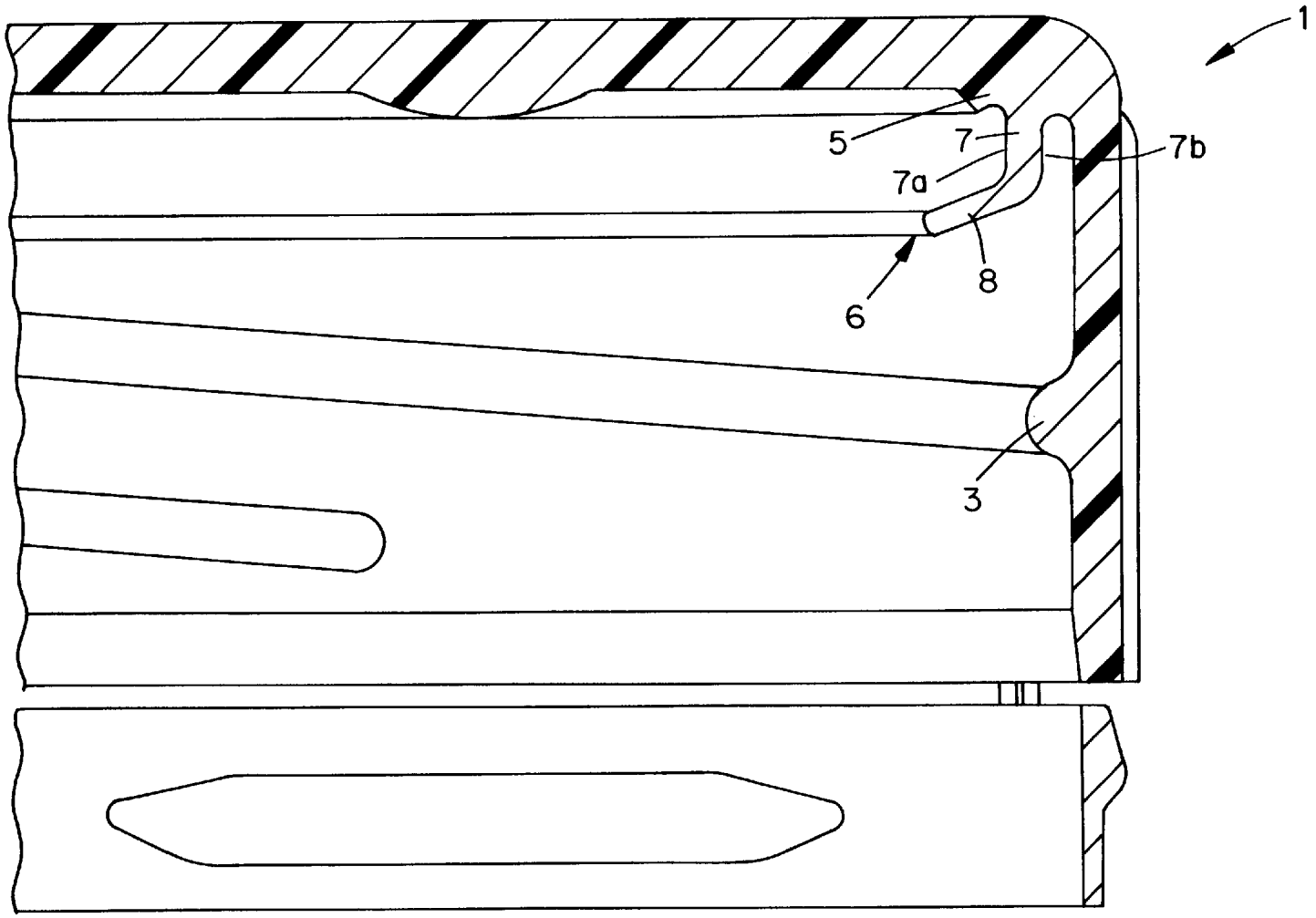
FIG. 3 is a partial view of an alternative embodiment of the closure of the invention shown in sectional elevation.

The alternative embodiment of FIG. 3 has a very much smaller inner rib 5 but is otherwise substantially the same as the embodiment of FIGS. 1 and 2.

The cap is modified (not illustrated) for containers not finished with an Alcoa step. Importantly, the inner diameter at the skirt and the thread dimensions must provide a secure engagement with the container thread. Further the inner dimension of the first portion 7 of the sealing rib 6 is preselected to be equal to, or slightly greater than, the external diameter of the container neck at the opening. Some radial flex should be provided in the sealing rib 6 so that on application of the cap to the container the second portion 8 can uniformly bend back onto the first portion 7.

Figure 4:
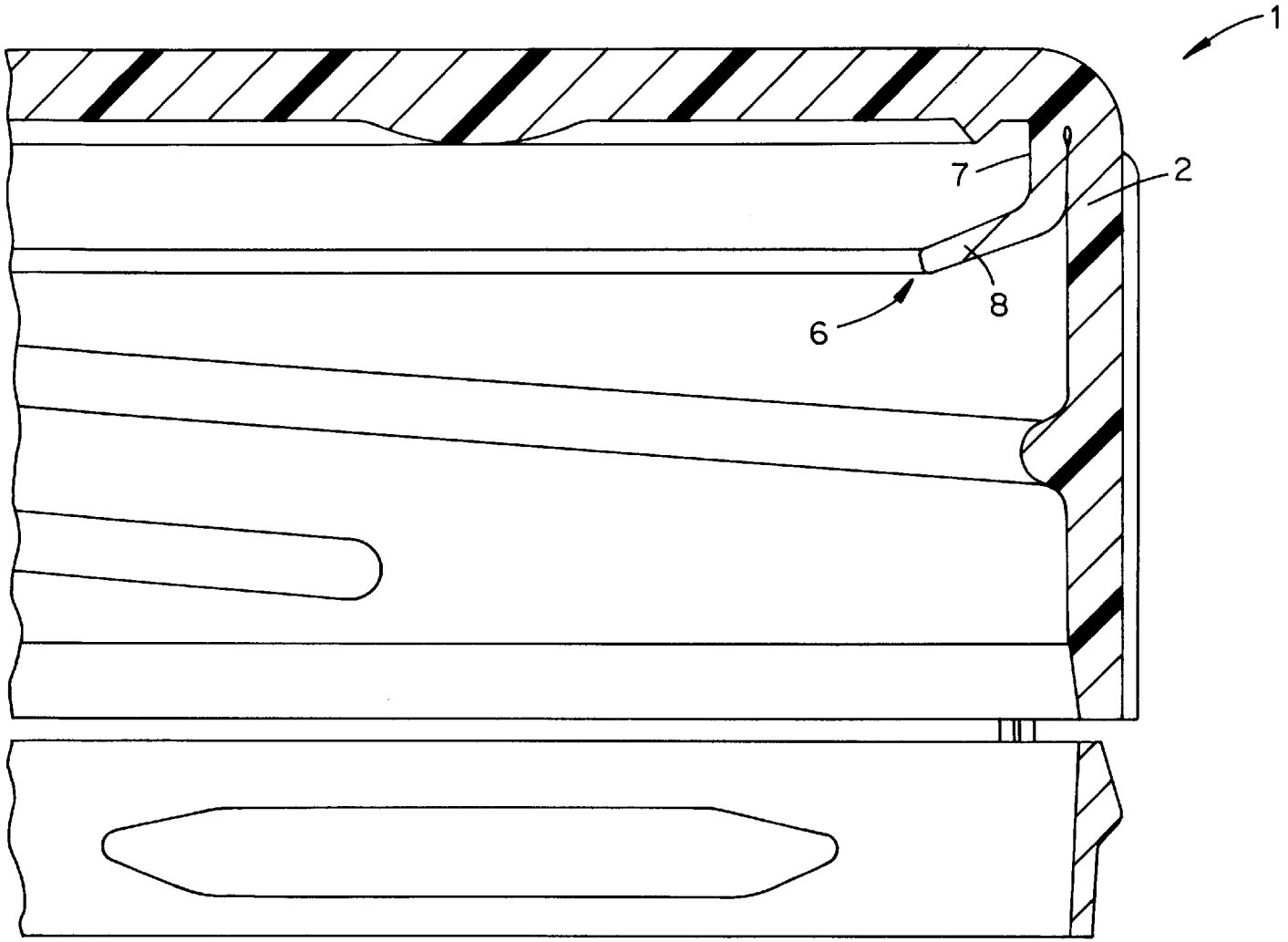
FIG. 4 is a view of the embodiment of FIG. 3, wherein the sealing rib is disposed contiguous to the skirt of the closure.

The embodiment of FIG. 4 shows the first portion of the rib 6 abutting the skirt 2.

Figure 5:
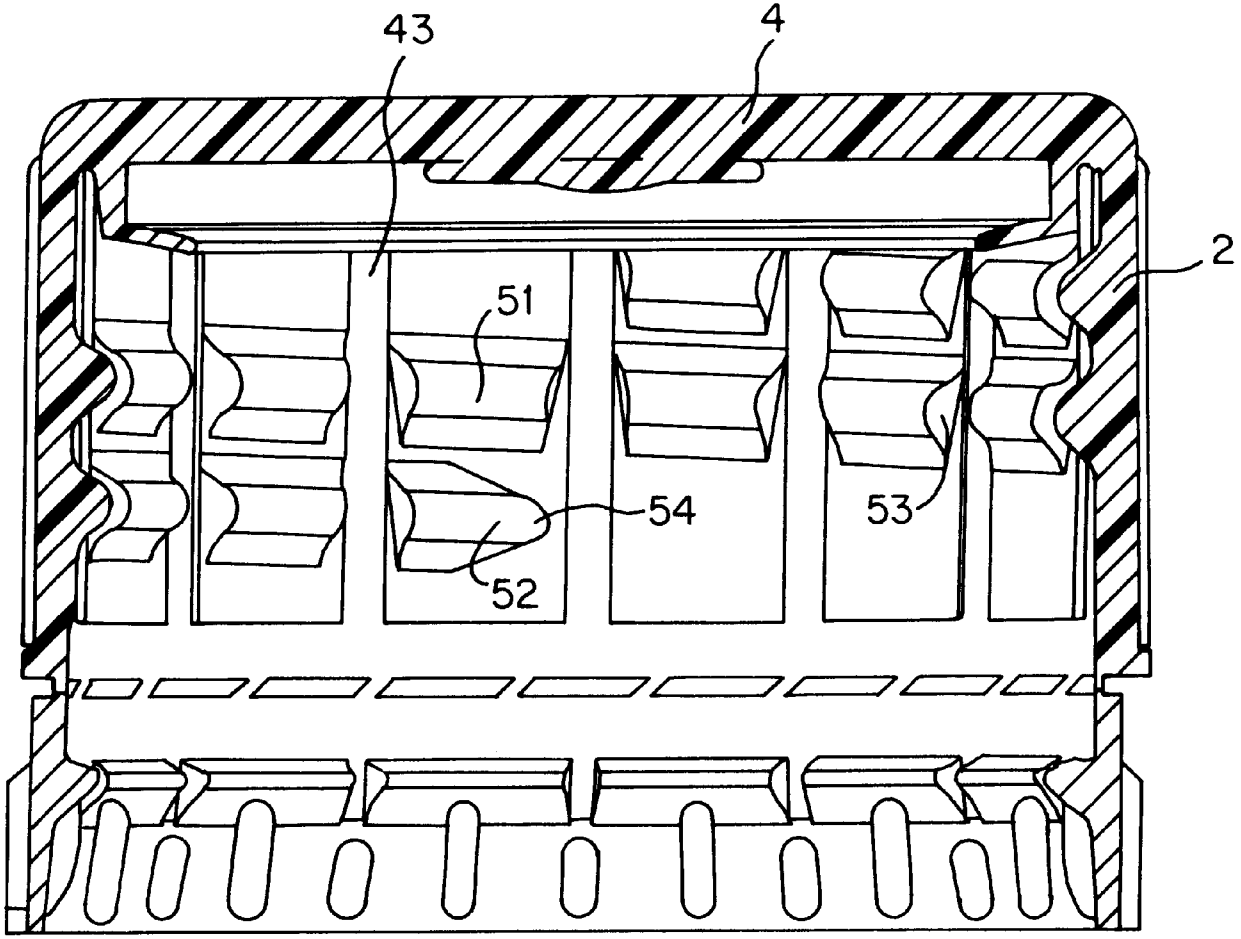
FIG. 5 is a cross-sectional view of a closure within the claims of this invention showing an improved configuration of the thread on the skirt of the closure.

Modifying the threads on the internal surface of the closure enhances the removal of the closing from the mold. As is best seen in FIG. 5, on the internal wall of the skirt 2 is a thread made up of a plurality of thread segments 51 arranged in spaced apart array along the locus of the thread. Each thread segment, except the first segment 52, is bounded at each end by a planar surface 53. Each of the planar surfaces 53 is inclined to the longitudinal axis of the closure 1 so that it faces away from the top 4. Each planar surface 53 is also inclined relative to a notional radial plane extending from the axis of the closure 1 to the planar surface 53 in question such that the minimum included angle between the planar surface 53 and the skirt 2 is acute and is less than the angle that a notional radial plane makes with the skirt 2.

The first thread segment 52 is formed with a planar surface 53 on its trailing edge, however it is formed with a point 54 on its leading edge to assist in mating the thread on the closure 1 with a corresponding thread on the neck of the container.

The thread segments 51 in each turn of the thread are aligned as are the spaces between them. A groove 43 is formed on the inside surface of the skirt 2 in each of the aligned spaces between adjacent thread segments 51. The grooves 43 serve to assist in venting gas from a carbonated beverage container as the closure 1 is unscrewed.

The closure 1 is molded on a mold core which defines, inter alia, the inside surface of the skirt 2, the thread segments 51 and the grooves 43. It has been found that by forming the thread segments 51 with planar surfaces 53, damage to the thread segments 51 upon the closure 1 being ejected off the mold core has been significantly reduced as compared with forming each of the thread segments with a pointed end similar to point 54.

Figure 6:
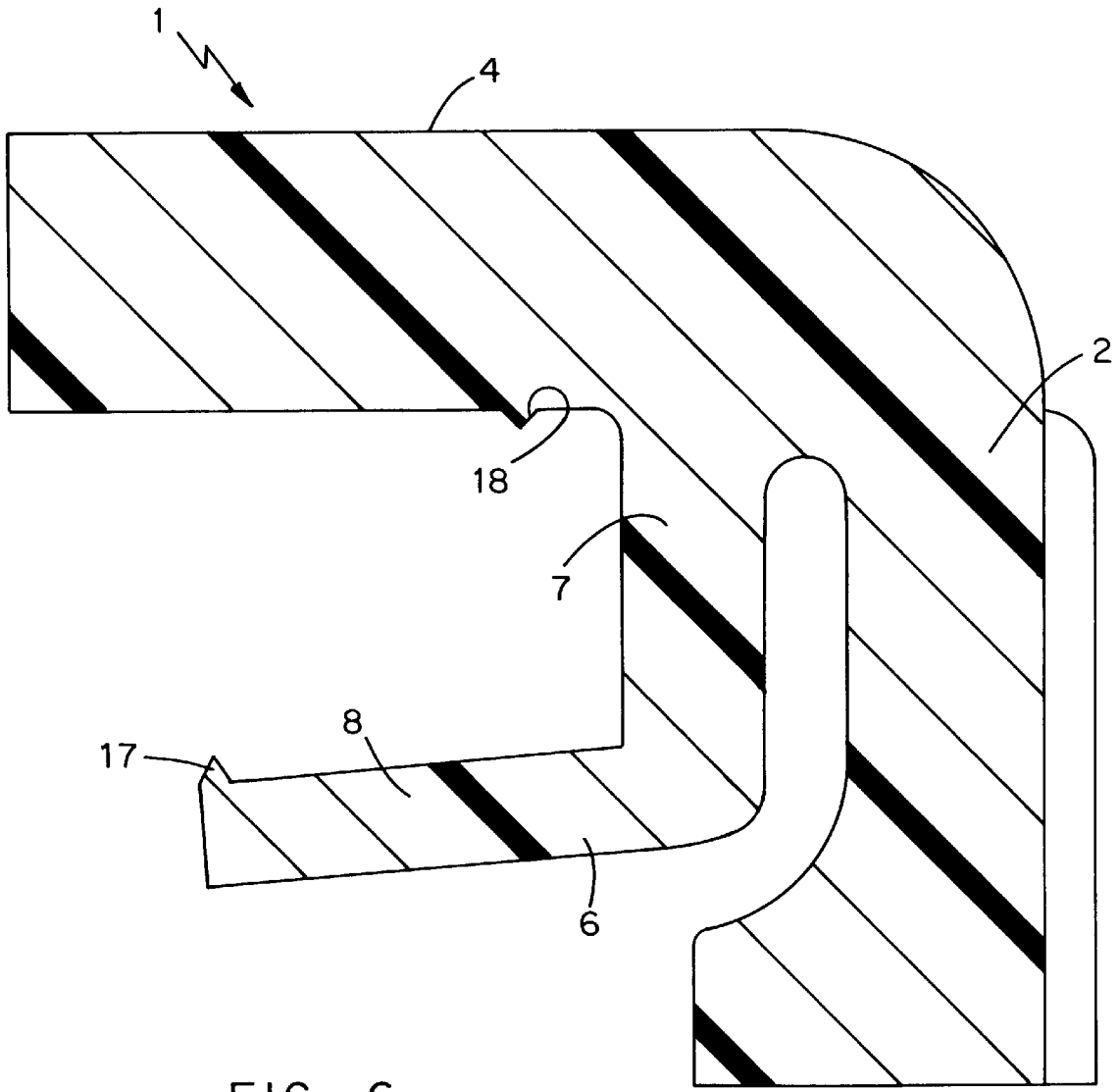
FIG. 6 is a partial cross-sectional view of a closure within the claims of this invention showing an improved sealing configuration.
Figure 7:
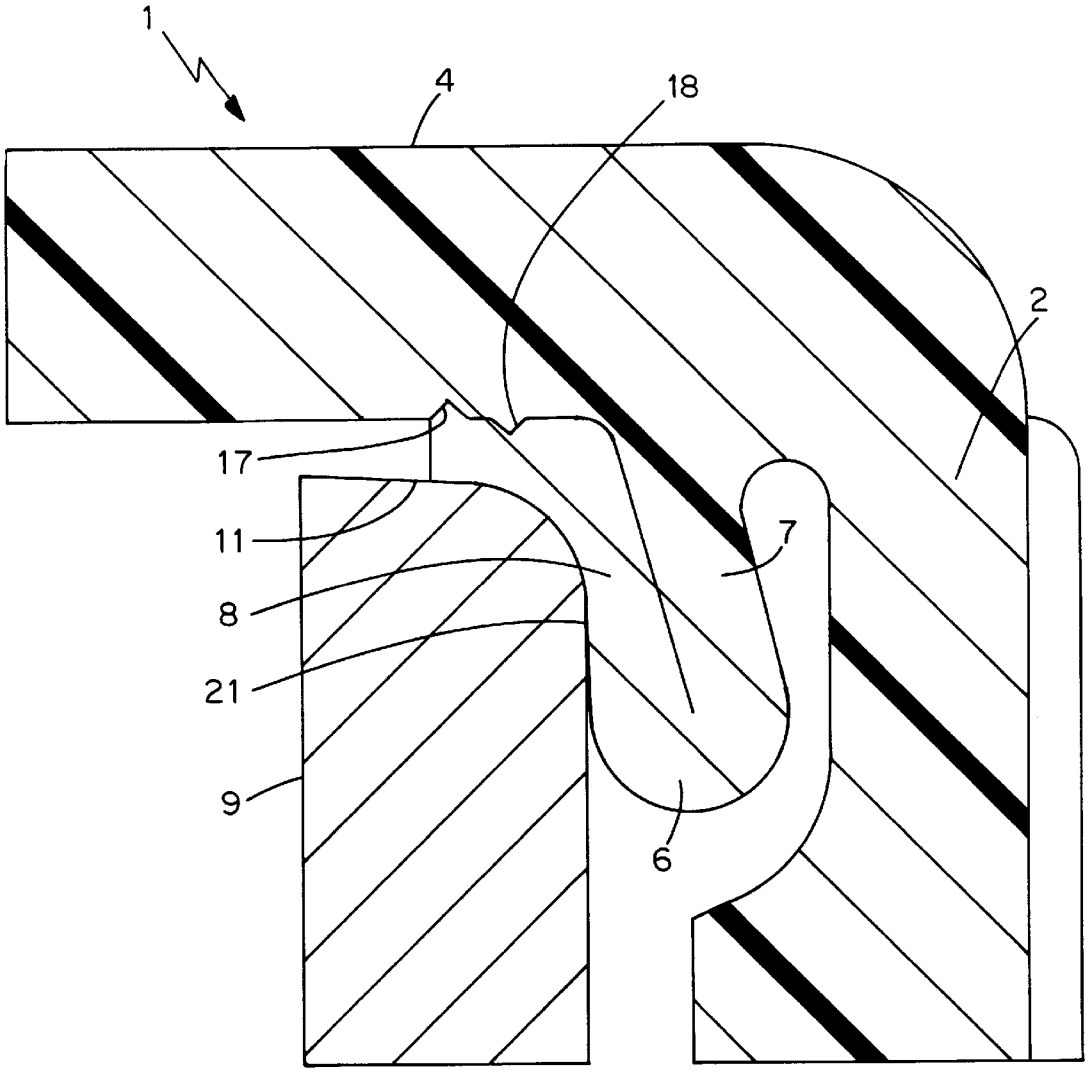
FIG. 7 is a partial cross-sectional view of the closure of FIG. 6 threaded onto a container.

As is best shown in FIGS. 6 and 7, the sealing of the closure of this invention and a container may be enhanced by modifying the sealing rib and the under surface of the top of the closure as described hereafter. The closure 1 includes an annular sealing rib 6 which extends from an underside of the top 4 concentrically of the closure 1 and positioned adjacent the skirt 2. The annular sealing rib 6 includes a first portion 7 which extends downwardly from the top 4 approximately parallel to the skirt 2, with a second portion 8 which, prior to engagement with the neck of a container 9, is frusto-conical and tapers inwardly and away from the skirt 2.

The second portion 8 has formed on its upper surface and proximate its free edge, a continuous annular ridge 17. The underside of the top 4 has formed on its surface inwardly of the first portion 7 of the rib 6 a continuous annular ridge 18.

As the closure 1 is being screwed onto the container 9, the second portion 8 of the rib 6 contacts the end 11 of the container 9 and is caused to fold up against the surface of the first portion 7. As the closure 1 is further screwed onto the container 9, contact is made between the underside of the top 4 and the ridge 17 and between the ridge 18 and the upper surface of the second portion 8 of the annular rib 6. Once this contact is made, further movement attaching the closure 1 will press and grip the contacting part of the second portion 8 between the end 11 of the container 9 and the top 4 of the closure 1 (as is best depicted in FIG. 7).

Thus, the movement attaching the closure 1 tends to pinch the second portion 8 of the rib 6 between the end 11 of the container 9 and the underside of the top and to "pull" the first portion 7 of the annular rib 6 tightly in towards the end 11 of the container 9 to produce a tight seal about the curved edge surface of the container 9 extending from its extreme end annular surface 11 down the side wall 21.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Set forth hereafter is an apparatus for positioning a screw threaded embodiment of the subject invention on an externally screw threaded neck of a moving container, the apparatus being best shown in FIGS. 8 and 9. This apparatus is designed to be placed above conveying means such as a star which is in a battling line. It is positioned after a closure dispensing unit and before a capping chuck.

The apparatus 100 includes a support block 110 in which one edge is recessed to form a portion 120 of an arcuate channel 130. The arcuate channel 130 has a first end 140, a second end 150 and is formed from a first arcuate wall (160 and 120), a second arcuate wall (170 and 180) and a top wall (190).

The first arcuate wall is formed from a first portion 160 and a second portion 120. The first portion 160 is an arcuate member that is rigidly attached to the support block 110 such that the surface 200 of the portion 160 is substantially aligned with the second portion 120. The second portion 120 comprises the face of the recess in support block 110.

The surface 200 of the portion 160 is a knurled metallic surface, the knurling on the surface corresponding to knurling on the outside surface of the skirt of the closure.

The second arcuate wall is radially displaced across the channel 130 from the first wall (160 and 120) and is formed from a first portion 170 and a second portion 180. The first portion 170 is a stainless steel sheet having a smooth face 220 and is attached to a block 210. The block 210 is biassed by means of two spring bolts 230 and 240. The spring bolts are mounted through a supporting plate 250. The supporting plate 250 is in turn mounted on another supporting plate 260 which extends upwardly from the upper surface 270 of the support block 110.

The second portion 180 of the second arcuate wall is substantially aligned with the face 220 of first portion 170 and is an edge of a block 280, the block 280 being rigidly attached to the support block 110.

The top wall 19 is normal to and positioned between the first arcuate wall (160 and 120) and second arcuate wall (170 and 180). The top wall is biassed around a hinge 290 mounted on a U-plate 300. The U-plate 300 extends from one edge 310 of the support block 110 and is attached to the support block 110 by means of two bolts 320 and 330. The bias on the top wall 190 around hinge 290 is controlled by two pneumatic rams 340 and a spring bolt return (not depicted) that extend through the support block 110 to the rear of the top wall 190.

In operation, the containers filled with their goods, such as a carbonated beverage, move along a bottling line to the closure dispensing unit. The closures are dispensed at an angle onto the neck of the container as each container passes the dispensing unit. The container with the collected closure moves to the pre-spin unit 100, which is the subject of the present invention. The closure positioned on the neck of the container enters the downwardly opening channel 130 at first end 140 and moves leftwardly as seen in FIG. 8, the top of the closure abutting the top wall 190. Adjacent the first end 140 the closure is constrained by the second portion 120 of the first arcuate wall which is an edge of the support block 110 and the second portion 180 of the second arcuate wall.

As the closure moves leftwardly, the skirt of the closure encounters the knurled metallic surface 200 on the first portion 160 of first wall, the knurling on the surface 200 corresponding to the knurling on the outside surface of the skirt of the closure thereby causing the closure to rotate around its own axis. Simultaneously, the closure is biassed by the first portion 170 of the second arcuate wall which comprises a block 210 to which is attached s stainless steel plate 170 having a smooth surface 220. The biassed block 210 ensures that the channel 130 is wide enough for the closure while ensuring that the surface 220 of the first portion 170 of the second arcuate wall remains in abutment to the skirt of the closure, no matter the shape of the closure, which in turn forces the skirt of the closure to remain in continuous abutment with the knurled surface 200 of the first portion 160 of the first arcuate wall.

The length of the knurled surface 200 on first portion 160 of the first arcuate wall can be defined so as to provide the desired pre-spin for any capping situation.

The biassing provided by block 210 provides enhanced control of the closure and ensures that the closure is coaxially aligned with the neck of the container on which the closure is being positioned.

The biassing provided by top wall 190 forces the closure onto the neck of the container such that the closure thread reliably engages the container neck thread as the closure rotates along the channel 130.

The depth of the channel 130 is controlled by the bias on the top wall 190. The depth is such that any tamper bands dependent from the skirt of the closure are clear of the first wall portions 160 and 120 and second wall portions 170 and 180.

The closure now engaged with the neck of the container exits the channel 130 at second end 150 and proceeds to the next capping stage. The biassed second wall 210 and top wall 190 of the apparatus 100 return to their original position ready for the entrance of another closure into the channel 130 at first end 140.

I claim:

1. A closure suitable for mounting onto a container having an opening defined by an end portion of the container, said closure being molded from a resilient, synthetic plastic material and comprising a top portion and a skirt portion depending from the top portion, an annular sealing rib projecting downwardly from an underside of the top portion, said rib including a first portion which is contiguous with the top portion and has a substantially cylindrical inner surface, which inner surface lies radially inwardly of the skirt portion, and a second, frusto-conical portion contiguous with an end of the first portion distal to the top portion and extending radially inwardly to terminate in a circular free edge, the first portion having an internal diameter relative to the external diameter of the end portion of the container such that during engagement of the closure with said end portion of the container the second frusto-conical portion of the sealing rib will be engaged by a free end of said end portion of the container and folded back toward the substantially cylindrical inner surface of the first portion of the rib to form a seal between at least an outer surface of said end portion of the container and the closure.

2. A closure as claimed in claim 1, in which the rib has a shape, size and position such that during final movement of attaching the closure to the container, said rib is disposed in a sealing relation between the top surface of said free end of said end portion of the container and the underside of the top portion of the closure.

3. A closure as claimed in claim 1, in which the undersurface of the top portion is defined in part by a second annular rib disposed radially inward of the first rib and extending downwardly from the underside of the top portion.

4. A closure as claimed in claim 1, in which said first portion of the rib extends from said top portion at a position radially displaced from said skirt portion to define a generally annular gap between said first portion and the skirt.

5. A closure as claimed in claim 1, in which the closure is molded in one piece.

6. A closure as claimed in claim 1, in which the first portion of the sealing rib is contiguous with the skirt portion.

7. A closure as claimed in claim 1, in which when the second, frusto-conical, portion of the sealing rib is engaged by said free end of said end portion of the container it is folded back toward the substantially cylindrical inner surface of the rib until the second portion makes contact with at least a part of the cylindrical inner surface of the first portion of the rib.

8. A closure as claimed in claim 7, in which the second portion makes contact with substantially all of the cylindrical inner surface of the first portion of the rib.

9. A closure as claimed in claim 1, in which the skirt portion of the closure has a screw thread formed on a radially inner surface which is adapted to cooperate with a complementary screw thread formed on a radially outer surface of the end portion of the container.

10. A closure suitable for mounting onto a container having an opening defined by an end portion of the container, said closure being molded from a resilient, synthetic plastics material and comprising a top portion and a skirt portion depending from the top portion, an annular sealing rib projecting downwardly from an underside of the top portion, said rib including a first portion which is contiguous with the top portion and has a substantially cylindrical inner surface, which inner surface lies radially inwardly of the skirt portion, and a second, frusto-conical portion contiguous with an end of the first portion distal to the top portion and extending radially inwardly to terminate in a circular free edge, the first portion having an internal diameter relative to the external diameter of the end portion of the container such that during engagement of the closure with said end portion of the container the second frusto-conical portion of the sealing rib will be engaged by a free end of said end portion of the container and folded back adjacent the substantially cylindrical inner surface of the first portion of the rib to form a seal between at least an outer surface of said end portion of the container and the closure.

11. A closure as claimed in claim 10, in which the rib has a shape, size and position such that during final movement of attaching the closure to the container, said rib is disposed in a sealing relation between the top surface of said free end of said end portion of the container and the underside of the top portion of the closure.

12. A closure as claimed in claim 10, in which the undersurface of the top portion is defined in part by a second annular rib disposed radially inward of the first rib and extending downwardly from the underside of the top portion.

13. A closure as claimed in claim 10, in which said first portion of the rib extends from said top portion at a position radially displaced from said skirt portion to define a generally annular gap between said first portion and the skirt.

14. A closure as claimed in claim 10, in which the closure is molded in one piece.

15. A closure as claimed in claim 10, in which the first portion of the sealing rib is contiguous with the skirt portion.

16. A closure as claimed in claim 10, in which when the second, frusto-conical, portion of the sealing rib is engaged by said free end of said end portion of the container it is folded back adjacent the substantially cylindrical inner surface of the rib until the second portion makes contact with at least a part of the cylindrical inner surface of the first portion of the rib.

17. A closure as claimed in claim 16, in which the second portion makes contact with substantially all of the cylindrical inner surface of the first portion of the rib.

18. A closure as claimed in claim 10, in which the skirt portion of the closure has a screw thread formed on a radially inner surface which is adapted to cooperate with a complementary screw thread formed on a radially outer surface of the end portion of the container.

19. A closure suitable for mounting onto a container having an opening defined by an end portion of the container, said closure being molded from a resilient, synthetic plastics material and comprising a top portion and a skirt portion depending from the top portion, an annular sealing rib projecting downwardly from an underside of the top portion, said rib including a first portion which is contiguous with the top portion and has a substantially cylindrical inner surface, which inner surface lies radially inwardly of the skirt portion, and a second, frusto-conical portion contiguous with an end of the first portion distal to the top portion and extending radially inwardly to terminate in a circular free edge, the first portion having an internal diameter relative to the external diameter of the end portion of the container such that during engagement of the closure with said end portion of the container the second, frusto-conical portion of the sealing rib will be engaged by a free end of said end portion of the container and folded back against the substantially cylindrical inner surface of the first portion of the rib to form a seal between at least an outer surface of said end portion of the container and the closure, said closure being molded in one piece.

20. A closure as claimed in claim 19, in which the first portion of the sealing rib is contiguous with the skirt portion.

21. A closure as claimed in claim 19, in which when the second, frusto-conical, portion of the sealing rib is engaged by said free end of said end portion of the container it is folded back against the substantially cylindrical inner surface of the rib until the second portion makes contact with at least a part of the cylindrical inner surface of the first portion of the rib.

22. A closure as claimed in claim 21, in which the second portion makes contact with substantially all of the cylindrical inner surface of the first portion of the rib.

23. A closure as claimed in claim 19, in which the skirt portion of the closure has a screw thread formed on a radially inner surface which is adapted to cooperate with a complementary screw thread formed on a radially outer surface of the end portion of the container.

* * * * *